US006481144B1

(12) United States Patent
Chee et al.

(10) Patent No.: US 6,481,144 B1
(45) Date of Patent: Nov. 19, 2002

(54) FIREARM

(75) Inventors: Tuck Wah Chee; Felix Tsai, both of Singapore (SG)

(73) Assignee: Ordnance Development & Engineering Company of Singapore, Singapore (SG)

( * ) Notice: Subject to any disclaimer, the term of this patent is extended or adjusted under 35 U.S.C. 154(b) by 0 days.

(21) Appl. No.: 09/637,465

(22) Filed: Aug. 14, 2000

(30) Foreign Application Priority Data

Aug. 20, 1999 (SG) ..... 9904457

(51) Int. Cl.[7] ..... F41A 21/28
(52) U.S. Cl. ..... 42/76.01; 42/75.02; 89/14.05
(58) Field of Search ..... 42/30, 76.01, 75.02; 89/14.05, 14.5

(56) References Cited

U.S. PATENT DOCUMENTS 2,797,515 A * 7/1957 Pagett ..... 42/75.02
4,841,835 A 6/1989 Bohler et al. ..... 89/12
5,020,260 A * 6/1991 Houghton ..... 42/75.02
5,218,163 A 6/1993 Dabrowski ..... 89/193
5,404,790 A * 4/1995 Averbukh ..... 89/193
5,737,865 A * 4/1998 Brandl et al. ..... 42/75.02
6,145,440 A * 11/2000 Franzen ..... 102/446

* cited by examiner

*Primary Examiner*—Stephen M. Johnson
(74) *Attorney, Agent, or Firm*—Ladas & Parry

(57) ABSTRACT

A firearm for discharging a high velocity projectile in which, to prevent injury to a firer from high pressure gases produced by an explosion in the fining chamber, a high pressure relief device is provided, which in normal use remains intact and permits normal firing of the projectile but in the event of an explosion in the firing chamber, high pressure gases which are produced rupture the high pressure relief device and vent the high pressure gases, in a direction away from the firer.

11 Claims, 3 Drawing Sheets

FIREARM

This invention concerns the incorporation of a high pressure venting mechanism into a firearm to prevent injuries to the firer in the event of a chamber explosion. This invention is especially suitable for a rifle of the "bull-pup" type where the barrel/ receiver is mounted in the bullstock.

BACKGROUND

In the typical firing cycle of a firearm, a chamber explosion may occur if there is a projectile stuck in the barrel bore and a defective round is fired. The effect of the chamber explosion will not only cause damage to the weapon, but will also cause injuries to the firer from the fragmentation of the rifle and the hot high-pressure gases produced as a result of the explosion.

This danger is particularly acute for the "bull-pup" type rifle, where the barrel/receiver assembly is mounted in the upper-receiver. The benefit of a bull-pup rifle is that the overall length of the rifle is shorter than other rifle types. However, the rifle is such that the magazine holder and firing chamber is behind the trigger mechanism. As a result, the location of the firing chamber is adjacent to the face of the firer when the firer is taking aim. When a right-handed firer is using his weapon to aim at the target, he will naturally rest his face on the left side of the weapon receiver body. Since the firer's face is adjacent to the firing chamber during firing, the extent and risk of injury to the firer is greater than for other types of rifles. To protect the firer's face in the event of a chamber explosion, the left receiver body must remain intact under the impact of a chamber explosion.

The receiver body is typically made of plastics material. In order to prevent fragmentation of the rifle in the event of a chamber explosion, the receiver body could be made of stronger material, such as metal, but that would increase the overall weight of the rifle and reduce the ease of use.

AIM OF THE PRESENT INVENTION

The aim of this invention is to ensure that there are no fragments hitting or hot gases burning a firer's face if the receiver body of the firearm breaks up into pieces due to high pressure gas acting on it in the event of a firing chamber explosion. Another aim of this invention is to minimise damage to the firearm in the event of a chamber explosion while at the same time using light-weight material for the receiver body to reduce the overall weight of the rifle.

Accordingly the present invention provides a firearm for discharging a high velocity projectile, the firearm comprising a body having a barrel communicating with a chamber for receiving the projectile and a firing mechanism for initiating projectile discharge, characterised in that the body has high pressure relief means disposed, in normal use, remotely from the firearm user for venting high pressure gases produced by a chamber explosion in a direction away from the user.

The venting of the chamber explosion gases reduces the chance of the body breaking up into pieces and minimises the possibility of injury to the user. The present invention will also minimize the effect of the explosion generally and cause less damage to the gun.

In a preferred embodiment the pressure relief means comprises an area of weakness which remains intact during normal firearm operation, and ruptures in the event of a chamber explosion to vent the high pressure gases. According to an exemplary embodiment, shield means are disposed on the opposite side of the body to the pressure relief means.

Preferably, the firearm is a rifle, and most preferably the rifle is of the "bull-pup" type.

BRIEF DESCRIPTION OF THE DRAWINGS

A clear understanding of the invention will be gained from the following detailed description, given by way of example only, with reference to the accompanying drawings, in which.

DETAILED DESCRIPTION OF THE INVENTION ILLUSTRATED WITH A PREFERRED EMBODIMENT

A typical firing cycle of a rifle, in particular a bull-pup rifle, is described below. The rifle (1) is a gas operated close-bolt automatic weapon. It can be fired at semi-automatic or fully-automatic mode depending on the mode of fire selected.

Figure 1:
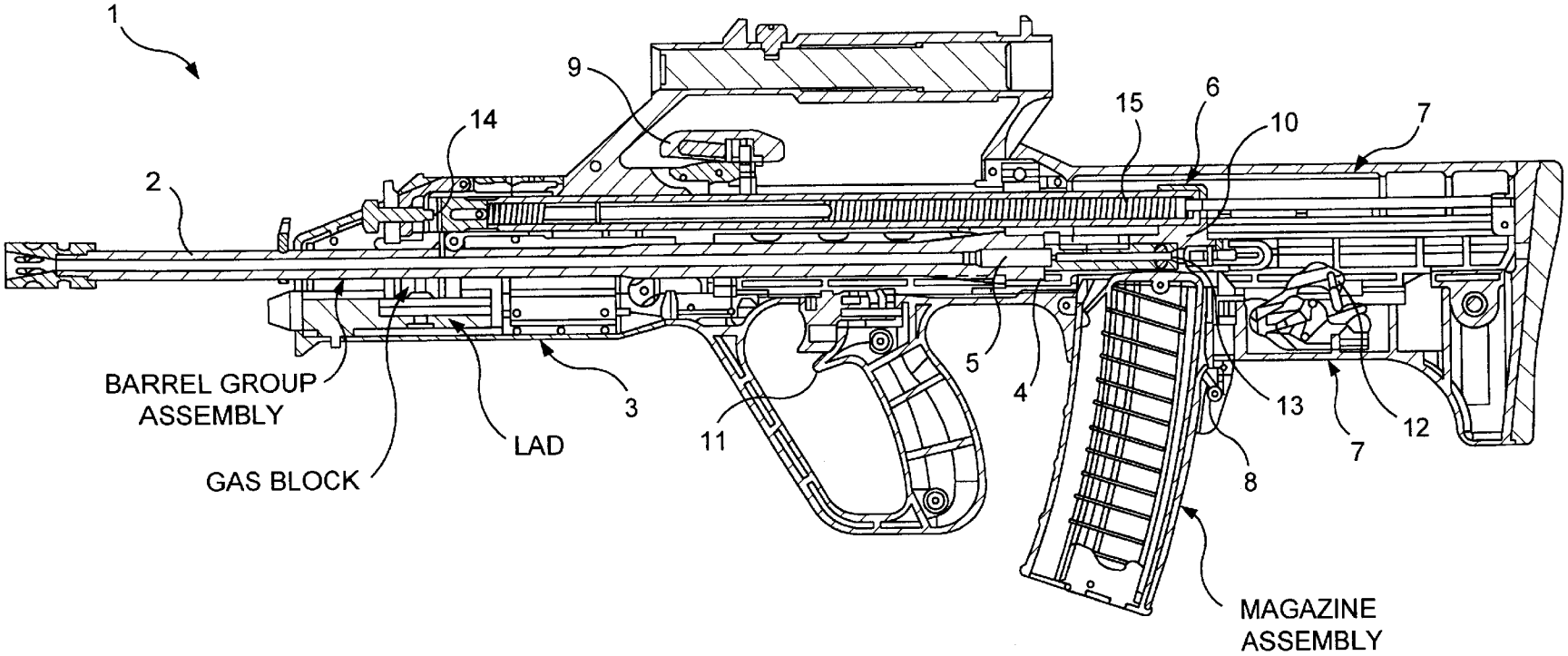
FIG. 1 is a left view of a rifle of the "bull-pup" type according to one embodiment of the invention.
Figure 2:
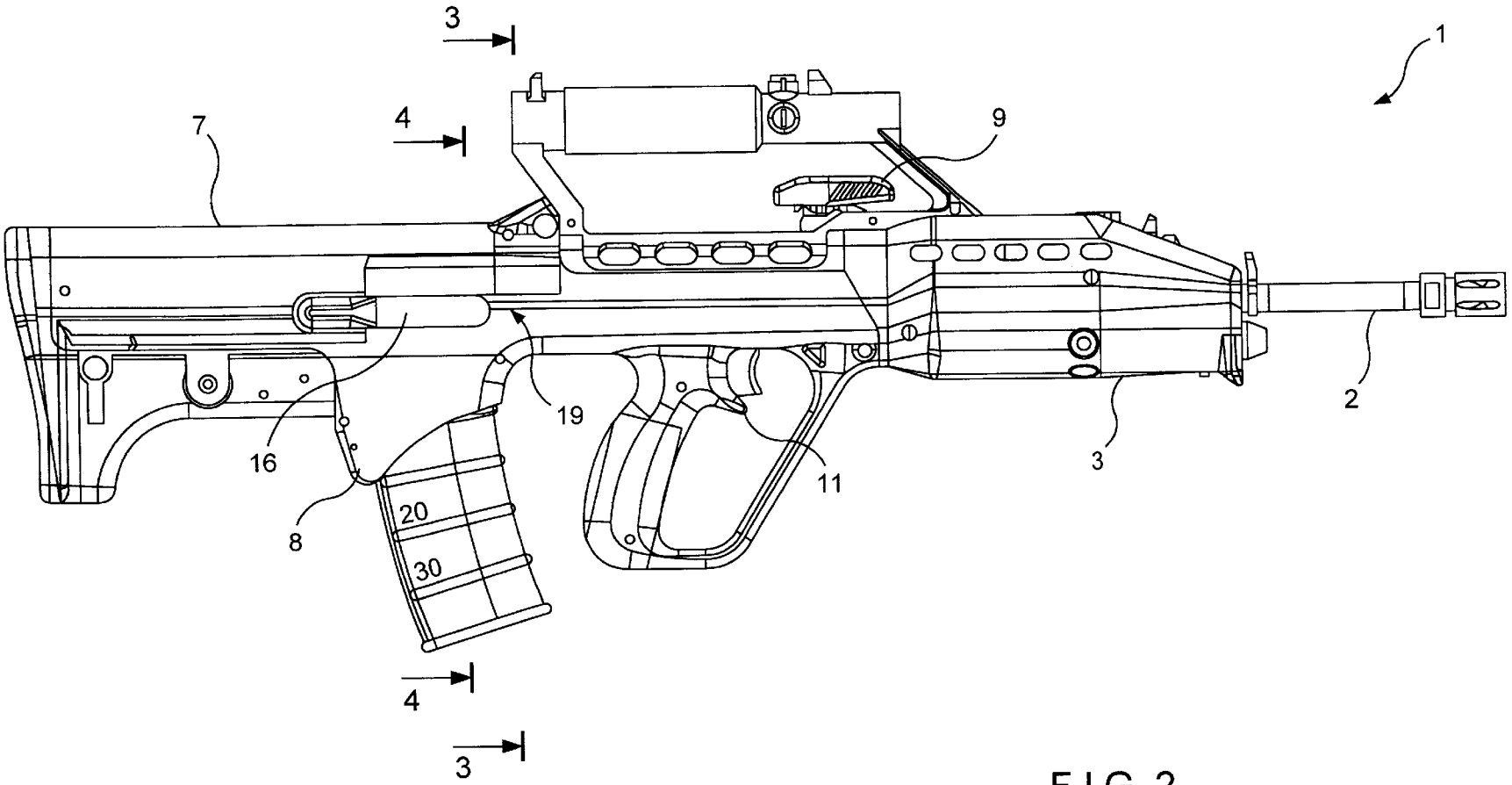
FIG. 2 is a right view of the rifle in FIG. 1.

Referring to FIGS. 1 and 2, the rifle comprises a barrel (2) connected to a barrel extension (4). A substantial portion of the barrel is covered by a handguard (3) which has a gas port (14) attached to it. Towards the rear end of the rifle (1), part of the barrel (2) and the barrel extension (4), are covered by a receiver body (7), usually made of plastics material. The trigger mechanism (11) is located in front of the barrel extension (4) whilst the firing chamber (5) and bolt carrier assembly (6) are located to the rear of the barrel extension (4). The bolt carrier assembly (6) further comprises a firing pin (13) which is used to hit the primer on a bullet/round which has been fed into the firing chamber (5).

Once the weapon is cocked by pulling the cocking lever (9), a bullet/round is fed into the firing chamber (5) from the magazine secured by the magazine holder (8) by the bolt (10). When the trigger (11) is depressed, the hammer (12) will be released and will strike the firing pin (13). The firing pin (13) will strike the primer on the bullet/round causing the bullet to fire. As a result, one round is fired through the barrel (2).

When the round passes through the gas port (14) adjacent to the barrel (2), the gas pressure is tapped to push the bolt carrier assembly (6) rearwards. As the bolt carrier assembly (6) moves to the rear, the bolt (10) is unlocked. The spent case is extracted out from the chamber and then ejected out through the ejection port (16) on the right. During this period, the main spring (15) housed inside the bolt carrier assembly (6) is being compressed.

Once the bolt carrier assembly reaches the rear, the stored energy in the main spring (15) will be released and will push the bolt carrier assembly (6) forwards. As the bolt carrier assembly (6) moves forward, the bolt (10) feeds the second round into the firing chamber (5). The whole firing cycle is repeated as long as the trigger (11) is depressed. The firing cycle is then complete. Upon releasing the trigger, the firing cycle immediately stops.

During the firing cycle, it is possible that a round is stuck in the bore of the barrel (2). If a defective bullet/round is then hit by the firing pin (13), the defective bullet/round may explode in the firing chamber (5), causing the receiver body (7) to fragmentate. Hot gases will also escape from the firing chamber (5) through the broken receiver body (7), injuring the firer, whose face is adjacent to the firing chamber (5) during firing.

Figure 3:
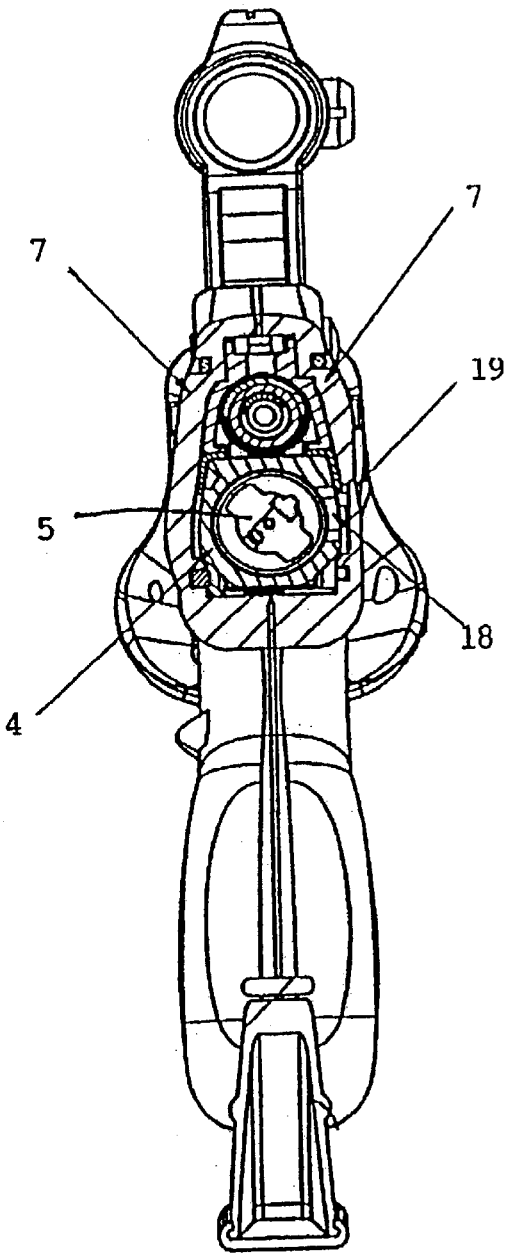
FIG. 3 is a cross-sectional view of the rifle in FIG. 1 taken along section 3—3.
Figure 4:
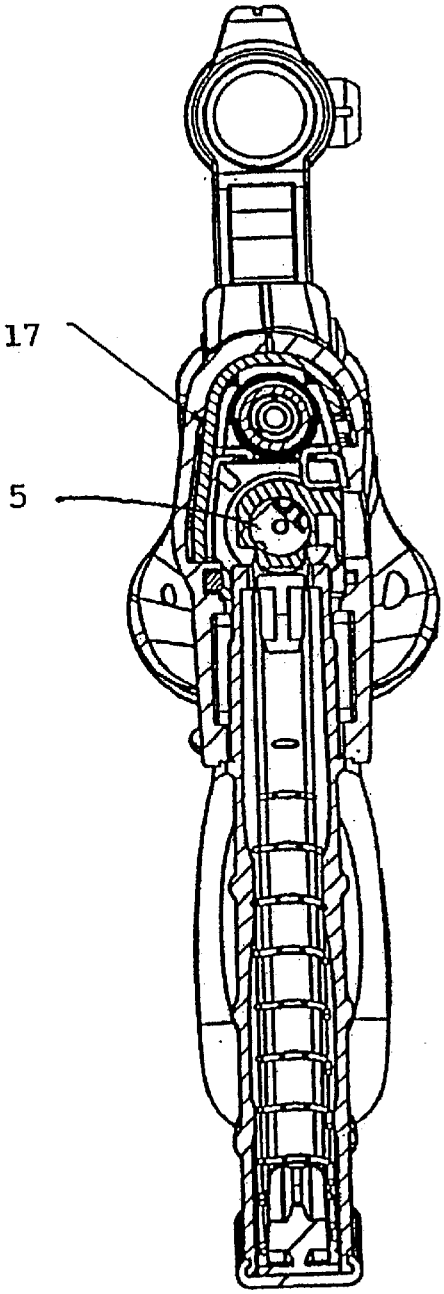
FIG. 4 is a cross-sectional view of the rifle in FIG. 1 taken along section 4—4.

Referring now to FIGS. 3 and 4, in the preferred embodiment of this invention, there is a safety shield (17) (preferably made up of Kevlar, an aramid plastic material made by DuPont, Wilmington, Del.) assembled on the inner surface of the left side of the receiver body (7). The barrel extension (4) which is screwed tight to the barrel (2) is assembled into the receiver body (7), which is usually made of plastics material. To vent out the high-pressure gas produced by a chamber explosion, there is a slot (18) milled on the right side of the barrel extension (4). The slot is covered by a thin-walled material (19), preferably plastic material, which is designed to puncture when there is high-pressure gas acting on it.

In the embodiment of the invention described above, the safety shield (17) is used to contain the explosion on the left side of the receiver body (7). The high-pressure gas will find its easiest path to emerge, and this will be the path of least resistence. Therefore, the high-pressure gas will travel through the barrel extension slot (18) and puncture the thin-walled plastics material (19) on the right side of the receiver body (7) and away from the face of the firer. The majority of high pressure gas will vent out through this way and will leave very little gas pressure acting on the left receiver body (7). As a result, the left receiver body (7) will be intact and no fragments are produced. Consequently, the firer's face will be protected.

By concentrating the release of high-pressure gas from a particular area, the damage to the receiver body (7) generally is also reduced.

This design of the above invention was incorporated into a rifle for testing. A stuck bore and/or defective round situation was simulated in an actual life-firing test. The test results show that the left receiver body remained intact, which meant that there would be no injury to the firer's face. On the right side of the receiver body, there was only very minor damage sustained, the high-pressure gases having been concentrated and vented out from the slot on the right side of the receiver body.

The invention described herein is susceptible to variations, modifications and/or additions other than those specifically described and it is to be understood that the invention includes all such variations, modifications and/or additions which fall within the spirit and scope of the above description. Although the preferred embodiment of the invention mentioned above relates to a rifle of the "bull-pup" type, the invention may also be suitable for other types of firearm.

Further, whilst the preferred embodiment is adapted for use by a right-handed user, it is plainly apparent that a firearm suitable for left-handed users could be provided.

What is claimed is:

1. A firearm for discharging a projectile, the firearm comprising a barrel, a barrel extension on said barrel, a body including a receiver portion in which said barrel extension is mounted, a firing chamber for receiving a projectile, said firing chamber communicating with said barrel extension to discharge the projectile from the firing chamber into the barrel extension and through the barrel when the projectile is fired, a firing mechanism for firing the projectile in the firing chamber and initiating discharge of the projectile into the barrel extension, and high pressure relief means disposed at said barrel extension remotely from a user for remaining intact during projectile discharge and for rupturing upon explosion of a projectile in the firing chamber to vent pressure gases produced by said explosion in the firing chamber in a direction away from the user.

2. A firearm according to claim 1, wherein said pressure relief means comprises an area of weakness which remains intact during projectile discharge, and ruptures in the event of explosion in the firing chamber to vent the pressure gases therefrom.

3. A firearm according to claims 1, wherein the pressure relief means comprises a slot in the area of the barrel extension immediately adjacent to the firing chamber.

4. A firearm according to claim 1, further comprising shield means disposed on a side of the body opposite the pressure relief means.

5. A firearm according to claim 4, wherein the shield means is disposed in the body in the area of the barrel extension immediately adjacent to the firing chamber.

6. A firearm according to claim 4, wherein the shield means comprises a sheet of plastic material.

7. A firearm according to claim 1, wherein said body is formed of a plastic material.

8. A firearm according to claim 1, further comprising a trigger mechanism and a magazine for supplying projectiles to the firing chamber, said trigger mechanism being disposed between the barrel and the magazine.

9. A firearm according to claim 1, wherein said high pressure relief means comprises a slot in said barrel extension and a cover on said slot which remains intact during projectile discharge but punctures in the event of explosion in the firing chamber to release the pressure gases produced thereby.

10. A firearm according to claim 9, wherein said body includes a receiver portion of plastic material into which said barrel extension is secured.

11. A firearm according to claim 10, comprising shield means in said receiver portion on a side of the barrel extension opposite said pressure relief means.

* * * * *

UNITED STATES PATENT AND TRADEMARK OFFICE

CERTIFICATE OF CORRECTION

PATENT NO. : 6,481,144 B1
DATED : November 19, 2002
INVENTOR(S) : Tuck Wah Chee et al.

It is certified that error appears in the above-identified patent and that said Letters Patent is hereby corrected as shown below:

Title page,
Item [73], Assignee, after "of Singapore" insert -- (1996) Pte. Ltd. --.

Signed and Sealed this

Eighteenth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,481,144 B1
DATED : November 19, 2002
INVENTOR(S) : Tuck Wah Chee et al.

It is certified that error appears in the above-identified patent and that said Letters Patent is hereby corrected as shown below:

Title page,
Item [30], "9904457" should read -- 9904457-0 --.

Signed and Sealed this

Twentieth Day of May, 2003

JAMES E. ROGAN
*Director of the United States Patent and Trademark Office*